US007162891B2

(12) United States Patent
Leuz

(10) Patent No.: US 7,162,891 B2
(45) Date of Patent: Jan. 16, 2007

(54) PIECE OF JEWELRY WITH STONE

(75) Inventor: Alexander Leuz, Frankfurt (DE)

(73) Assignee: Gebruder Schaffrath GmbH, Hanau (DE)

( * ) Notice: Subject to any disclaimer, the term of this patent is extended or adjusted under 35 U.S.C. 154(b) by 0 days.

(21) Appl. No.: 10/359,708

(22) Filed: Feb. 7, 2003

(65) Prior Publication Data

US 2003/0177789 A1 Sep. 25, 2003

(30) Foreign Application Priority Data

Feb. 7, 2002 (DE) ..... 102 04 911

(51) Int. Cl.
*A44C 17/02* (2006.01)

(52) U.S. Cl. ..... 63/31; 63/26

(58) Field of Classification Search ..... 63/26–32; D11/86, 87, 91, 92
See application file for complete search history.

(56) References Cited

U.S. PATENT DOCUMENTS

| | | | | |
|---|---|---|---|---|
| 693,084 A * | 2/1902 | Townsend | 63/32 |
| 2,258,413 A | 6/1941 | Koven | 63/31 |
| 4,081,972 A * | 4/1978 | Kotlar | 63/31 |
| 4,220,018 A * | 9/1980 | Chuard | 63/29.1 |
| 5,177,984 A | 1/1993 | Arata | 63/26 |
| 6,324,869 B1 * | 12/2001 | Vanlioglu | 63/31 |
| 6,532,766 B1 * | 3/2003 | Chia et al. | 63/26 |
| 2003/0188550 A1 * | 10/2003 | Oki et al. | |

FOREIGN PATENT DOCUMENTS

| | | | | |
|---|---|---|---|---|
| DE | 31 04 396 A1 | | 8/1982 | |
| DE | 297 16 980 U1 | | 12/1997 | |
| DE | 299 06 564 U1 | | 5/1999 | |
| IT | 531 444 | * | 8/1955 | 63/31 |
| JP | 62-48211 | * | 3/1987 | 63/31 |
| JP | 3076475 | * | 1/2001 | 63/31 |

* cited by examiner

*Primary Examiner*—Robert J. Sandy
*Assistant Examiner*—Ruth C. Rodriguez
(74) *Attorney, Agent, or Firm*—Harness, Dickey & Pierce, P.L.C.

(57) ABSTRACT

A piece of jewelry includes a foundation for mounting at least one stone. The stone is at least regionally inserted in a depression of the foundation of the piece of jewelry. At least one securing element is arranged for the stone, in the area of the foundation. The stone is movably arranged in the region of the foundation and the securing element is arranged at a distance from the stone.

19 Claims, 2 Drawing Sheets

PIECE OF JEWELRY WITH STONE

This application claims priority on German Patent Application number DE 102 04 911.4 filed Feb. 7, 2002, the entire contents of which are hereby incorporated herein by reference.

FIELD OF THE INVENTION

The invention generally concerns a piece of jewelry which has a mounting for at least one stone. Preferably, it is directed to one in which the stone is inserted at least regionally into a depression of the foundation of the piece of jewelry and in which at least one securing element for the stone is arranged in the area of the foundation.

BACKGROUND OF THE INVENTION

Pieces of jewelry are known in various embodiments and can be realized as rings, bracelets, pendants, earrings, parts of a necklace, etc. The pieces of jewelry are typically made of a noble metal or noble metal alloy and mount precious stones in one or more mountings. Other embodiments are made of steel, aluminum or further metals or alloys.

SUMMARY OF THE INVENTION

An objective of an embodiment of the present invention is to construct a piece of jewelry such that improved possibilities for presentation of the stone are provided.

An objective may be accomplished in accordance with an embodiment of the invention wherein the stone is movably arranged in the region of the foundation and wherein the securing element has a distance from the stone.

It is possible for the stone to experience a change in position relative to the foundation, even with the smallest vibrations or other acting forces. In this way, it is possible for the stone to assume another orientation toward the incident light. As such, a perfect glittering and sparkling in a large number of nuances, especially with diamonds, may be bolstered.

The arrangement of the securing element at a distance to the stone makes a change of position of the stone, relative to the foundation, possible. In addition to this, however, dependable mobile mounting of the stone is guaranteed without conventional mounting. The securing element moreover guarantees that the stone glides back into its basic position after conclusion of the action of force and in this way executes a new change of position. With each motion of the person wearing the piece of jewelry, reflections varying greatly relative to one another can be called forth by the mobile arrangement of the stone in the region of the foundation.

A high mobility of the stone is especially bolstered in one embodiment wherein the depression is tapered.

A rotation motion of the stone inside the foundation may be made possible by the depression tapering conically in the region of a dip.

An appropriate configuration of the stone, in one embodiment, includes the stone tapers proceeding from a base.

In another embodiment, the stone tapers conically.

To support a good visibility of the stone with simultaneous reliable positioning of the stone in the region of the foundation, it is proposed that in one embodiment, the dip occupy an end region of the tapering of the stone.

In one embodiment, the foundation is basically constructed ring-shaped. Basically, a large number of other forms is possible.

To promote a pleasing outer configuration in another embodiment, the depression basically passes over rounded into an outer contour of the foundation.

A good visibility of the stone is likewise promoted by the depression being constructed laterally open at least regionally.

A reliable mounting of the stone in the region of the foundation with a simultaneously pleasing outer appearance may be attained by the securing element being constructed to be looplike.

A further basic variant may include two loop-like securing elements being arranged at a distance and basically parallel to each other.

Constructing the securing element of at least two loop segments which overhang the stone, in each case preferably in edge regions, contributes to an increased visibility of the stone.

A once again increased multiplicity of optical reflection generated may be attained by at least two stones being mounted movably in one depression in each case.

For example, in one embodiment, the stone is constructed as a precious stone. Basically, however, applications in connection with costume jewelry, for example, can also be realized.

A very great variety of colors with the optical reflection may be attained by the stone being constructed as a polished diamond.

BRIEF DESCRIPTION OF THE DRAWINGS

Embodiments of the invention are represented schematically in the drawings, wherein.

DETAILED DESCRIPTION OF THE PREFERRED EMBODIMENTS

Figure 1:
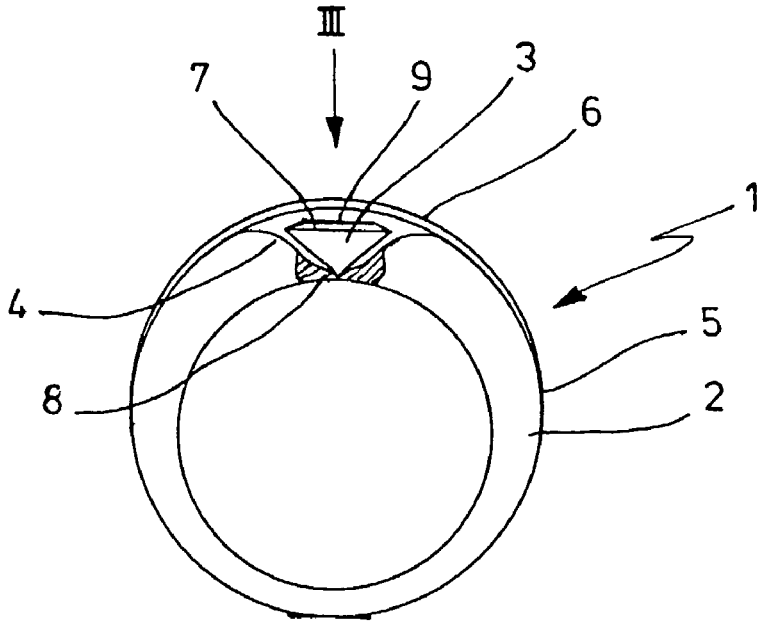
FIG. 1 illustrates a side view of an annular piece of jewelry with a movably mounted stone and a loop-like securing element.
Figure 2:
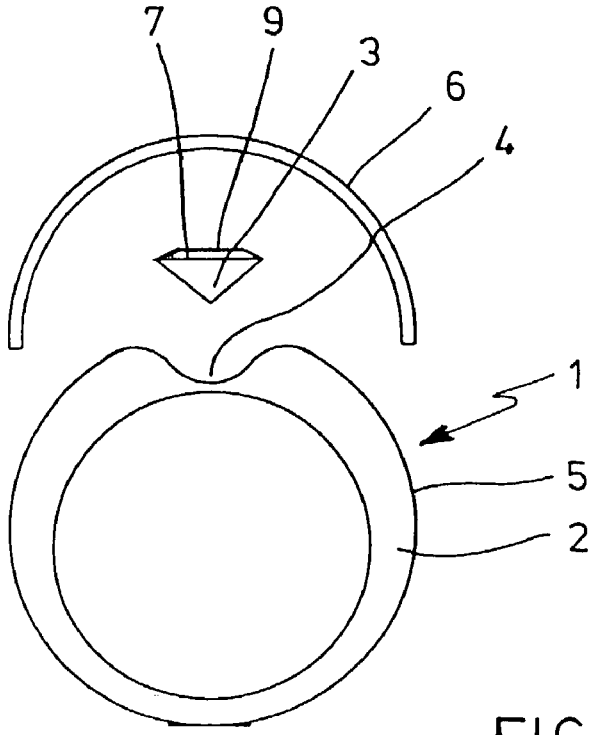
FIG. 2 illustrates a piece of jewelry in accordance with FIG. 1 before connecting the securing element with the foundation.

In accordance with the embodiment in FIG. 1, the piece of jewelry (1) is realized in the form of a ring which has a foundation (2) and which mounts a stone (3). The foundation (2) is provided with a depression (4) into which the stone (3) is inserted. It is particularly intended to transition the depression (4) rounded into an outer contour (5) of the piece of jewelry (1). A securing element (6) is arranged above the depression (4) which is constructed loop-like in accordance with the embodiment in FIG. 1 and has a distance from the stone (3).

With the embodiment represented in FIG. 1, the stone (3) possesses a basically conically tapering body which extends proceeding from an internal circular base (7). The base (7)

is arranged facing the securing element (6). A faceted arching (9) provided with a large number of polished surfaces of the stone (3) runs over the base (7) in the visible region. An end region of the tapering of the stone (3) arranged facing away from the base (7) is positioned in a dip (8) of the depression (4). The coverage region between the tapering of the stone (3) and the dip (8) is selected so large that even if the base (7) is installed on the securing element (6), a lateral guidance of the stone (3) is guaranteed. In this way, a loss of the stone (3) is prevented.

Figure 3:
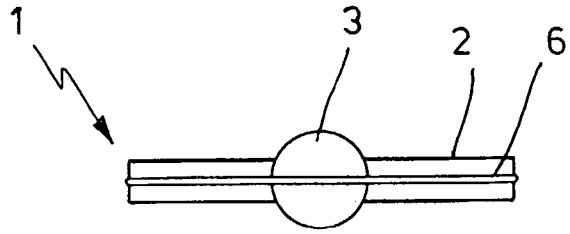
FIG. 3 illustrates a top view in accordance with direction of view III in FIG. 1.

It is recognizable on the basis of the representation in FIG. 3, that the tapering region of the stone (3) tapers to a point. The securing element (6) can be constructed as a semicircular loop which is soldered with the foundation (2) after assembly. But other fastening variants are also realizable. In particular, additional connection methods, laser welding, riveting, gluing or form-locking joinings, etc. can also be realized.

Figure 4:
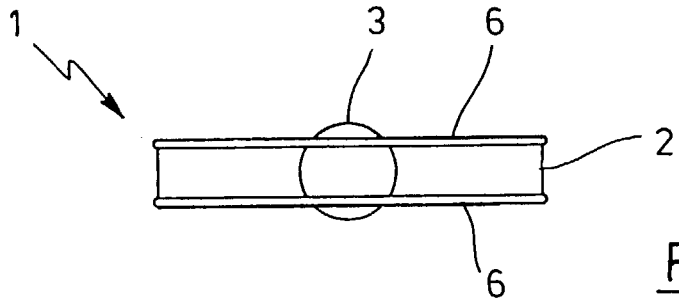
FIG. 4 illustrates a modification modified in relation to FIG. 3 with two loop-like securing elements parallel to each other.

In the top view in FIG. 3, it is recognizable that the loop-like securing element (6) extends in a basically central region relative to a width of the foundation (2). With the embodiment in accordance with FIG. 4, two loop-like securing elements (6) are provided which run along the edges of the foundation (2) and basically parallel relative to each other.

Figure 5:
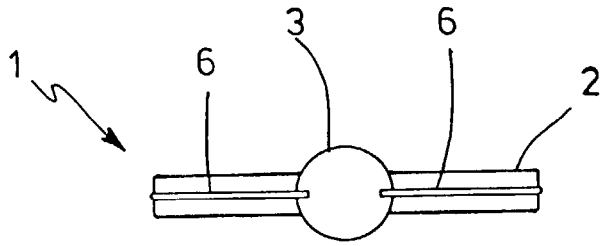
FIG. 5 illustrates a further embodiment modified in relation to FIG. 3 with an interrupted securing element and FIG. 6 illustrates an embodiment modified in relation to FIG. 1 in which three stones are movably mounted.

With the embodiment in accordance with FIG. 5, two securing elements (6) are used which are arranged similar to securing element (6) in accordance with FIG. 3, but do not completely overarch the stone (3) but project only in the edge region. In this way, an improved visibility of the stone (3) is promoted. The securing elements (6) in accordance with FIG. 5 can be realized as edge segments of the securing element (6) according to FIG. 3.

Figure 6:
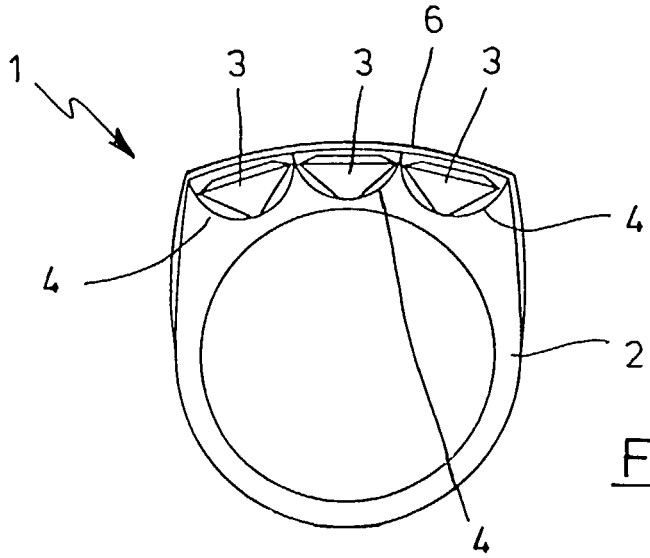

With the embodiment in accordance with FIG. 6, three stones (3) are mounted in each case in allocated depressions (4). Since as a rule each stone (3) is positioned different relative to the foundation (2) when acted upon by forces, a once again improved optical effect is attained through an arrangement of several mobile stones (3). In accordance with FIG. 6, the stones (3) are arranged one after the other in a row. Other arrangements, however, are also realizable.

The construction represented in the embodiments with a conically tapering stone (3) and the dip (8) likewise configured in the form of a cone drawn inward makes possible a large number of different directions of motion of the stone (3). The stone (3) can first of all be slid in the direction of the conic longitudinal axis up to a stop against the securing element (6). Moreover, the stone (3) can be tipped crosswise to the conic long axis in each radial direction. Finally, a rotation about the conic long axis is also possible. There is consequently a large number of free motion parameters which cause a large number of different light reflections with a facet-like polished stone (3).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A piece of jewelry, comprising:

a foundation for mounting at least one stone, wherein the stone is at least regionally inserted into a depression of the foundation, the foundation having side walls that are at least partially open; and at least one securing element for the stone, arranged in the region of the foundation, wherein the stone is movably arranged in the region of the foundation and wherein the securing element is arranged at a distance from the stone;

wherein the depression and the stone cooperate to return the stone to a predetermined basic orientation in which a reference axis of the depression and a reference axis of the stone coincide, when the reference axis of the depression is vertically oriented;

wherein the stone is arranged between the foundation and the securing element so that at least a main part of a border of the stone, which is between a base and a faceted arching, is not covered by the securing element, the border being the widest part of the stone.

2. A piece of jewelry according to claim 1, wherein the depression tapers.

3. A piece of jewelry according to claim 1, wherein the depression tapers conically in the region of a dip.

4. A piece of jewelry according to claim 1, wherein the stone tapers proceeding from the base.

5. A piece of jewelry according to claim 4, wherein the stone tapers conically.

6. A piece of jewelry according to claim 1, wherein a dip occupies an end region of the depression of the foundation.

7. A piece of jewelry according to claim 1, wherein the foundation is basically ring-shaped.

8. A piece of jewelry according to claim 1, wherein the depression is transitioned basically rounded into an outer contour of the foundation.

9. A piece of jewelry according to claim 1, wherein the depression is constructed laterally open at least regionally.

10. A piece of jewelry according to claim 1, wherein the securing element is loop-shaped.

11. A piece of jewelry according to claim 1, wherein two loop-shaped securing elements are arranged at a distance from the stone and basically parallel relative to each other.

12. A piece of jewelry according to claim 1, wherein the securing element is made of at least two loop segments which project over the stone in edge regions.

13. A piece of jewelry according to claim 1, wherein at least two stones are movably mounted.

14. A piece of jewelry according to claim 1, wherein the stone is a precious stone.

15. A piece of jewelry according to claim 1, wherein the stone is a polished diamond.

16. A piece of jewelry according to claim 2, wherein the securing element is loop-shaped.

17. A piece of jewelry according to claim 2, wherein two loop-shaped securing elements are arranged at a distance from the stone and basically parallel relative to each other.

18. A piece of jewelry according to claim 2, wherein the securing element is made of at least two loop segments which project over the stone in edge regions.

19. A piece of jewelry according to claim 10, wherein at least two stones are movably mounted.

* * * * *